US005240409A

United States Patent [19]

Xiong

[11] Patent Number: 5,240,409

[45] Date of Patent: Aug. 31, 1993

[54] PREMIXED FUEL/AIR BURNERS

[75] Inventor: Tian-yu Xiong, Darien, Ill.

[73] Assignee: Institute of Gas Technology, Chicago, Ill.

[21] Appl. No.: 866,344

[22] Filed: Apr. 10, 1992

[51] Int. Cl.[5] ..... F23C 5/06

[52] U.S. Cl. ..... 431/189; 431/186; 431/354; 239/414

[58] Field of Search ..... 431/354, 189, 186, 60, 431/160, 12, 202, 159; 239/414, 401

[56] References Cited

U.S. PATENT DOCUMENTS 1,127,815 2/1915 Shaw .
1,289,042 12/1918 Campbell .
1,434,238 10/1922 Weber .
1,490,008 4/1924 Hetsch .
1,667,365 4/1928 Ward .
1,695,215 12/1928 Staples ..... 431/186
1,702,298 2/1929 Hetsch .
1,763,387 6/1930 Beach ..... 431/189 X
2,316,881 4/1943 Morse et al. .
2,368,178 1/1945 Turpin ..... 431/186 X
3,091,283 5/1963 Kidwell .
3,533,717 10/1970 Guerin ..... 431/186 X
3,721,387 3/1973 Wilmot, Jr. .
3,782,884 1/1974 Shumaker ..... 431/186
3,915,621 10/1975 Iverson ..... 431/189
4,755,136 7/1988 Gotte .

*Primary Examiner*—Larry Jones
*Attorney, Agent, or Firm*—Speckman, Pauley & Fejer

[57] ABSTRACT

A premixed fuel/air burner with velocity and fuel/air ratio control having a nozzle with a nozzle wall forming a Venturi mixer and a nozzle exit, means for separately introducing fuel and air into the Venturi mixer, a hollow body disposed in the nozzle and moveable in a longitudinal direction toward the nozzle exit, the hollow body having at least on orifice through a wall thereof at an angle with respect to a longitudinal axis of the nozzle such that fuel is injected through said orifice into the Venturi mixer. Movement of the hollow body toward the nozzle exit changes the cross-sectional area of the Venturi mixer and nozzle exit thereby permitting control of nozzle velocity of the resulting fuel/air mixture. To control the fuel/air ratio, a fixed orifice baffle is provided inside the hollow body which changes the opening of the orifice as the hollow body is moved toward the nozzle exit.

8 Claims, 3 Drawing Sheets

PREMIXED FUEL/AIR BURNERS

BACKGROUND OF THE INVENTION

1. Field of the Invention

This invention relates to a method and apparatus for controlling velocity and fuel/air ratio in premixed gas fired burners.

2. Description of the Prior Art

Premixed gas fired combustion is known to be a superior combustion mode for minimizing pollutant emissions, in particular, nitrogen oxides ($NO_x$). However, known methods of premixing fuel and combustion air employ mixing far upstream of the burner nozzle, thereby creating a substantial risk of flame flashback, particularly, at low load operations, due to the nozzle velocity which decreases almost proportionally with load reduction.

Another known method of premixing fuel and air, known as nozzle mixing involves mixing fuel and air within the nozzle. However, such methods cannot achieve perfect mixing due to the poor aerodynamic design and fixed cross-sectional area of the mixing channel in the nozzle. In addition, good mixing of the fuel and air at low load operation is not possible. Finally, known nozzle mixing methods do not permit the ratio of fuel and air to be adjusted within the nozzle to meet the requirements for turndown operation.

U.S. Pat. No. 1,702,298 teaches a burner for furnaces having a tubular casing with separate air and combustible gas inlets, the end of the burner casing facing the furnace being open, while the rear end of the casing is in enclosed by a cover having a tubular inward projection to which a threaded extension is attached. Disposed at the outlet end of the tubular projection having an opening through which the combustible gas flows is a tubular sliding piston which is moveable within the burner casing to control the flow of air and gas through the open end of the burner. Similarly, U.S. Pat. No. 4,755,136 teaches a burner for gaseous fuels in which two concentric tubular pistons control the introduction of gaseous fuel and air into a mixing chamber, the gaseous fuel being introduced through openings from the center of the inner piston into the mixing chamber and the air being introduced through openings in the surface of the outer piston into the mixing chamber.

A moveable insert for controlling the mixture of fuel and air within the nozzle of a burner is taught by U.S. Pat. No. 1,490,008 which discloses a burner for liquid fuel with a centrally inserted regulating piece having a conical end surrounded by an annular mixing chamber. U.S. Pat. No. 1,289,042 teaches a blow torch having a centrally positioned tube provided with a central passage connected to a gaseous fuel supply source, the tube having a plurality of discharge openings. Slidably mounted on the central gaseous fuel supply tube is a cylindrical valve, the movement of which regulates the amount of air flowing from an annular chamber around the centrally positioned tube as well as the amount of gaseous fuel from the centrally positioned tube through the discharge nozzle of the blow torch. Use of a moveable insert or plug in a mixing chamber area for regulating the flow of fluids therethrough is also taught by U.S. Pat. No. 3,721,387 which teaches an ejector having a variable primary nozzle area and mixing chamber are in which the plug in the mixing area varies not only the area of the primary nozzle but also changes the size of the length of the mixing chamber.

See also U.S. Pat. Nos. 1,434,238; 1,127,815; 1,667,365; 2,316,881; and 3,091,283, all of which relate to the combustion of oil, as opposed to a gaseous fuel, having means for adjusting the flow of air to control atomization of the oil and the firing rate of the burners. A premixed gaseous fuel fired burner with velocity and fuel/air ratio control is not taught by the known prior art.

SUMMARY OF THE INVENTION

Accordingly, it is an object of this invention to provide a premixed gaseous fuel fired burner with velocity and fuel/air ratio control.

It is an object of this invention to provide a premixed gaseous fuel fired burner in which pollutant emissions, in particular, nitrogen oxides ($NO_x$) are reduced.

It is yet another object of this invention to provide a premixed gaseous fuel fired burner in which the risk of flame flashback, particularly at low load operation, is virtually eliminated.

It is yet another object of this invention to provide a premixed gaseous fuel fired burner with good mixing of fuel and air at low load operation.

It is yet another object of this invention to provide a premixed gaseous fuel fired burner in which the ratio of fuel and air is automatically adjustable to meet the requirements for turndown operation.

These and other objects are achieved in accordance with a premixed fuel/air burner of this invention having a nozzle with a nozzle wall which forms a Venturi mixer and a nozzle exit. Disposed within the nozzle is a hollow body which is moveable in a longitudinal direction toward the nozzle exit. The hollow body is shaped such that the cross-sectional area of the Venturi mixer and the nozzle exit is reduced as the hollow body is moved towards the nozzle exit. The burner is provided with means for separately introducing a gaseous fuel, preferably natural gas, and oxidant, preferably air, into the nozzle, the gaseous fuel being directed into the hollow body and air being directed around the outside of the hollow body. The hollow body is provided with at least one orifice through a wall thereof at an angle with respect to a longitudinal axis of the nozzle. Air passing through the Venturi mixer aspirates the gaseous fuel from within the hollow body through the orifice, at which point the gaseous fuel and air mix before being ejected through the nozzle exit. When load is reduced, resulting in a corresponding reduction of air flow rate, the hollow body is moved toward the nozzle exit and the cross-sectional areas of the Venturi mixer and the nozzle exit are reduced, thereby reducing fuel flow rate to meet reduced load and air flow rate requirements while increasing the velocity of the fuel/air mixture flowing through the nozzle exit to maintain a desired level for optimization of combustion performance.

In accordance with one embodiment of this invention, means for directing the gaseous fuel to contact the end of the hollow body facing the nozzle exit are provided within the hollow body to provide cooling to the tip of the nozzle. In accordance with one embodiment of this invention, said means for directing the fuel to contact the tip of the hollow body comprises a flow baffle disposed at the outlet of the gaseous fuel supply, which outlet is in communication with the hollow body.

The gaseous fuel fired burner in accordance with this invention is sufficiently flexible to meet the requirements of different patterns and directions of nozzle injections, different ranges of operating parameters, as well as different turndown ratios for a variety of burner and combustor applications. In accordance with one embodiment of this invention, the nozzle is designed to provide axial injection of the premixed fuel and air. In accordance with another embodiment of this invention, the nozzle is designed to provide radial injection of the premixed fuel and air. In yet another embodiment of this invention, the nozzle is designed to provide tangential injection of the premixed fuel and air. In all of the aforementioned embodiments, the nozzle can be designed to provide a straight or swirling flow pattern to the premixed fuel and air as desired.

To control the amount of fuel mixing with air, there is provided within the hollow body means for changing the cross-sectional area of the orifice or orifices through which the fuel flows from the hollow body into the Venturi mixer in the nozzle. In accordance with one embodiment of this invention, said means for changing the cross-sectional area of the orifice or orifices comprises a fixed orifice baffle affixed to the means for moving the hollow body toward the nozzle exit. Thus, the cross-sectional area of the orifice or orifices changes to satisfy the fuel/air ratio requirements as the hollow body is moved toward the nozzle exit.

BRIEF DESCRIPTION OF THE DRAWINGS

These and other features of this invention will be better understood from the detailed description taken in conjunction with the figures in which.

DESCRIPTION OF PREFERRED EMBODIMENTS

Figure 1:
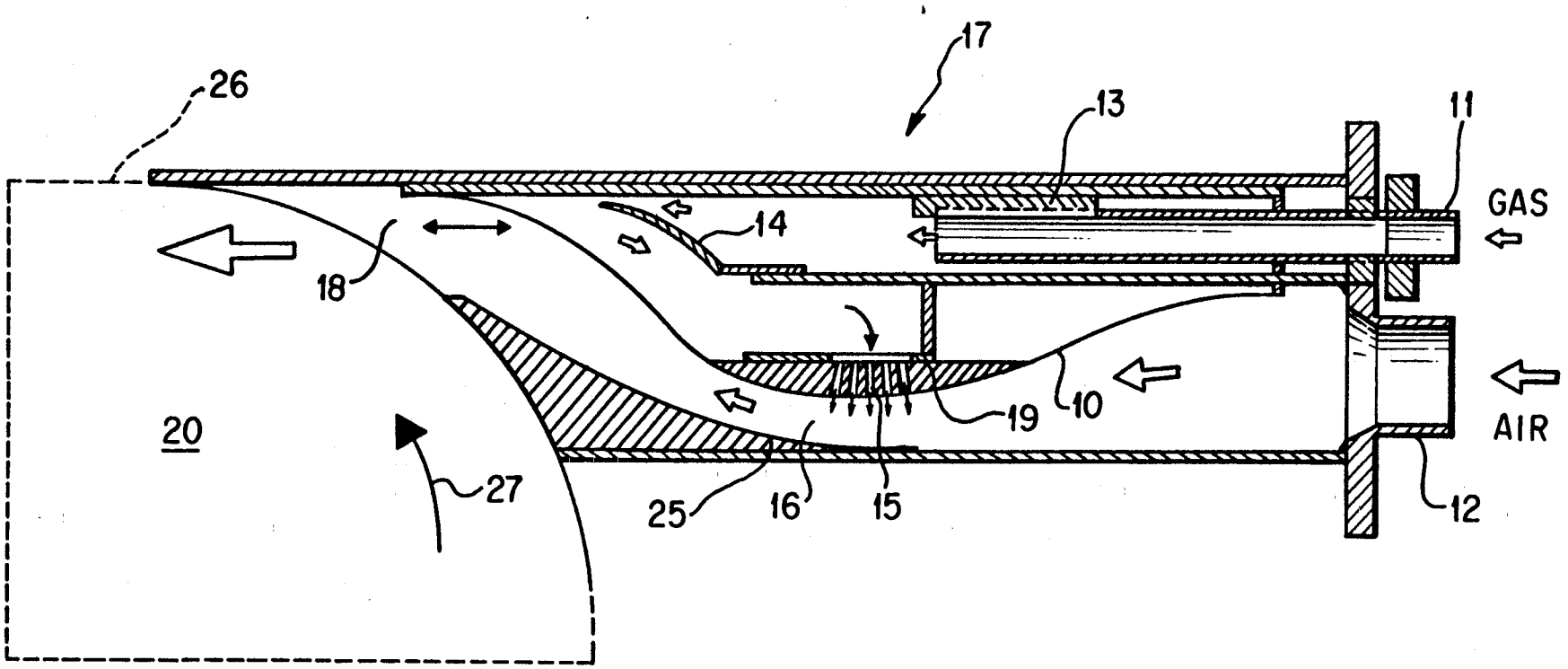
FIG. 1 shows a cross-sectional side view of a variable velocity premixing tangential nozzle with fuel/air ratio control in accordance with one embodiment of this invention.

FIG. 1 shows a premix fuel/air burner having velocity and fuel/air ratio control suitable for tangential firing into combustion chamber 20, only a portion of which is shown, in accordance with one embodiment of this invention. The premixed fuel/air burner in accordance with this embodiment comprises nozzle 17, the wall 25 of which forms Venturi mixer 16 and nozzle exit 18. Disposed within nozzle 17 is hollow body 10 which is movable in a longitudinal direction toward nozzle exit 18. As hollow body 10 moves toward nozzle exit 18, the cross-sectional areas of Venturi mixer 16 and nozzle exit 18 are reduced.

Hollow body 10 is connected to means for moving hollow body 10, in accordance with one embodiment of this invention, in the form of slide 13 disposed inside hollow body 10. It will be apparent that other means for moving hollow body 10 are possible, such as connection of hollow body 10 to a threaded bar which is rotated to displace hollow body 10.

Nozzle 17 is provided with means for separately introducing fuel and air. Hollow body 10 is in communication with means for introducing fuel whereby the fuel to be burned, preferably natural gas, is directed inside of hollow body 10. Coupled to said means for introducing said fuel into hollow body 10 are means for cooling an end of hollow body 10 facing nozzle exit 18, and thus combustion chamber 20. In accordance with one embodiment of this invention disposed at the outlet of said means for introducing fuel is flow baffle 14 which directs a stream of fuel toward the end of hollow body 10 facing nozzle exit 18, thereby providing a cooling effect at nozzle exit 18.

Oxidant, preferably air, is introduced through oxidant inlet 12 into nozzle 17, passing over the surface of hollow body 10, through Venturi mixer 16, and nozzle exit 18 into combustion chamber 20.

Hollow body 10 is provided with at least one orifice 15 at an angle with respect to a longitudinal axis of nozzle 17 whereby fuel in hollow body 10 is aspirated by air passing through Venturi mixer 16, thereby forming a fuel/air mixture which passes through nozzle exit 18 into combustion chamber 20 where it is ignited. As hollow body 10 is moved toward nozzle exit 18, the velocity of air or oxidant passing through Venturi mixer 16 as well as the velocity of the resulting fuel/air mixture passing through nozzle exit 18 increases. Moving hollow body 10 away from nozzle exit 18 reduces the velocity of the air and resulting fuel/air mixture introduced into combustion chamber 20.

To provide effective fuel/air ratio control, fixed within hollow body 10 is fixed orifice baffle 19. Fixed orifice baffle 19 is secured to said means for moving said hollow body such that when hollow body 10 is moved in a longitudinal direction, fixed orifice baffle 19 changes the opening of orifice 15, thereby permitting automatic adjustment of fuel flow rate through orifice 15 to provide the desired control.

In operation, in accordance with the embodiment shown in FIG. 1 which is specifically applicable to a cyclonic combustor, the direction of fuel/air mixture injection from nozzle exit 18 is always tangential to the combustor wall to generate a cyclonic flow pattern designated by arrow 27 in the combustor regardless of the position of hollow body 10 in nozzle 17. Nozzle velocity, an essential parameter for controlling the combustion characteristics of a cyclonic combustor, such as internal flow recirculation, flame stability, and combustion emissions, particularly, at turndown operation, can be adjusted at a favorable level for optimal combustion control. Fuel flow rate is also controlled by fixed orifice baffle 19 to match the air flow rate through Venturi mixer 16 for the desired fuel/air ratio. For example, when the load requirement is decreased, the flow of air or oxidant is reduced. To compensate for this reduction in flow rate, hollow body 10 is moved forward toward nozzle exit 18 to reduce the cross-sectional area of nozzle exit 18 to maintain nozzle velocity for optimized combustion control. Correspondingly, a portion of orifice 15 will be blocked by fixed orifice baffle 19 resulting in a reduction of fuel flow rate to match the reduced oxidant air flow rate for effective fuel/air ratio control. At the same time, the cross-sectional area of Venturi mixer 16 is reduced to maintain sufficient mixer speed for good mixing. In this manner, the relationship between air flow rate, gas flow rate, Venturi mixer speed, and nozzle velocity can be adequately maintained to meet the requirements for optimized combustion control at different firing rates.

Figure 2:
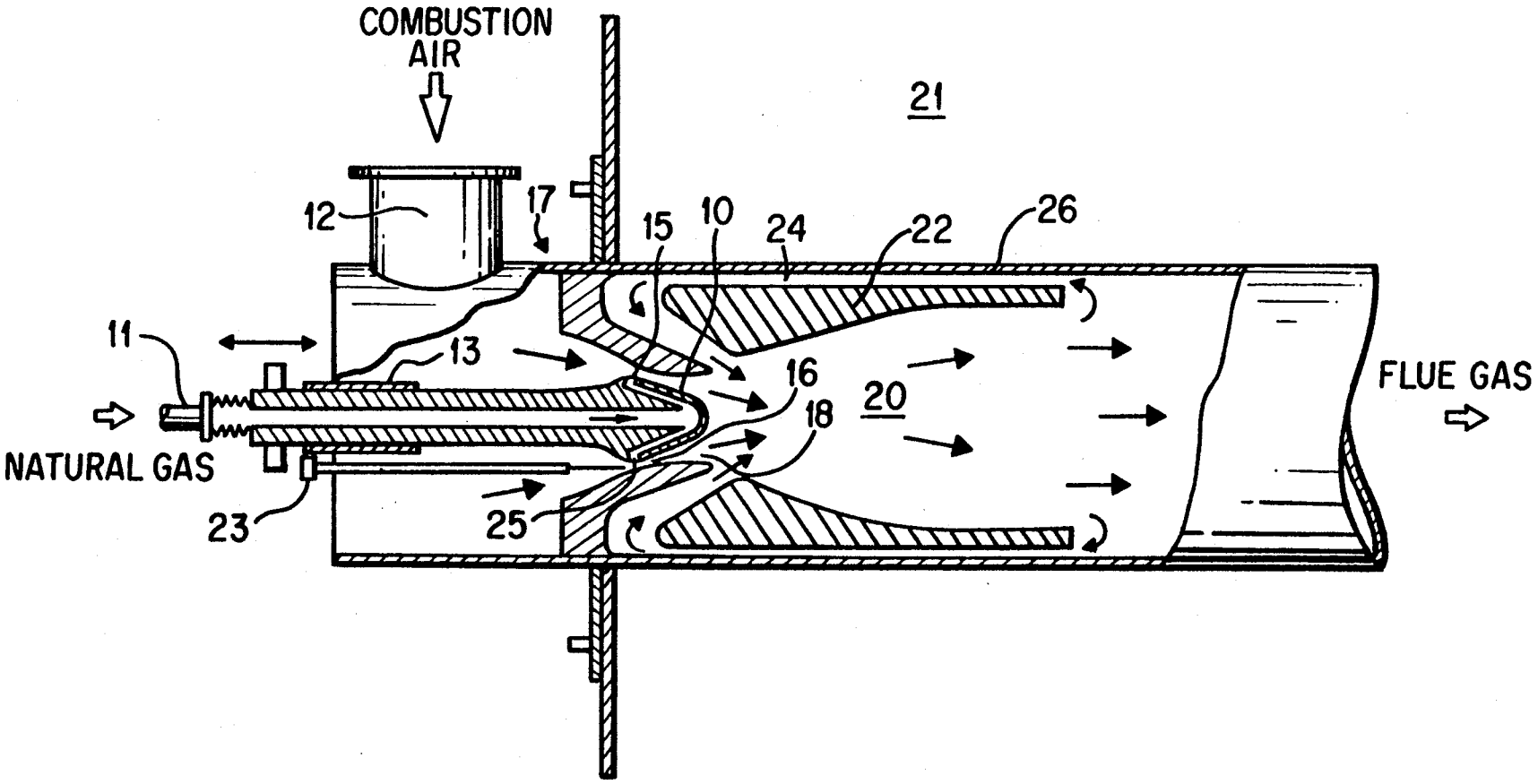
FIG. 2 is a cross-sectional side view of a variable velocity premixing nozzle with fuel/air ratio control for a recirculating gas fired burner in accordance with another embodiment of this invention.

FIG. 2 shows another embodiment in accordance with this invention of a premixed fuel/air burner having velocity and fuel/air ratio control and having means for recirculating flue gases from downstream of nozzle exit 18 toward nozzle exit 18. As in the embodiment of this invention applied to a cyclonic combustor, nozzle wall 25 forms Venturi mixer 16 and nozzle exit 18. Disposed within nozzle 17 is hollow body 10 having orifice 15 through which fuel from fuel supply 11 passes from hollow body 10 into Venturi mixer 16. Hollow body 10 is moveable toward nozzle exit 18 by means for moving hollow body 10, such as, slide 13. Oxidant, preferably combustion air, is introduced into nozzle 17 through oxidant inlet 12 and passes through Venturi mixer 16, nozzle exit 18, and into combustion chamber 20. As the oxidant passes through Venturi mixer 16, fuel is aspirated through orifice 15 into mixer 16 and the resulting fuel/oxidant mixture is introduced into combustion chamber 20 through nozzle exit 18. As hollow body 10 is moved toward nozzle exit 18, the cross-sectional area of Venturi mixer 16 and nozzle exit 18 is reduced, thereby increasing the velocity of the mixture exiting through nozzle exit 18. The resulting mixture is ignited by igniter 23. Disposed within combustion chamber 20 is recirculation sleeve 22 which forms annular space 24 with combustion chamber wall 26. As the fuel/oxidant mixture passes nozzle exit 18, a negative pressure is created near the upstream end of recirculation sleeve 22 resulting in aspiration of flue gases through annular space 24 from a downstream end of combustion chamber 20. By changing the velocity of the fuel/oxidant mixture exiting nozzle exit 18, by moving hollow body 10 into or out of Venturi mixer 16 as desired, the amount of flue gas recirculation through annular space 24 can be controlled.

Figure 3:
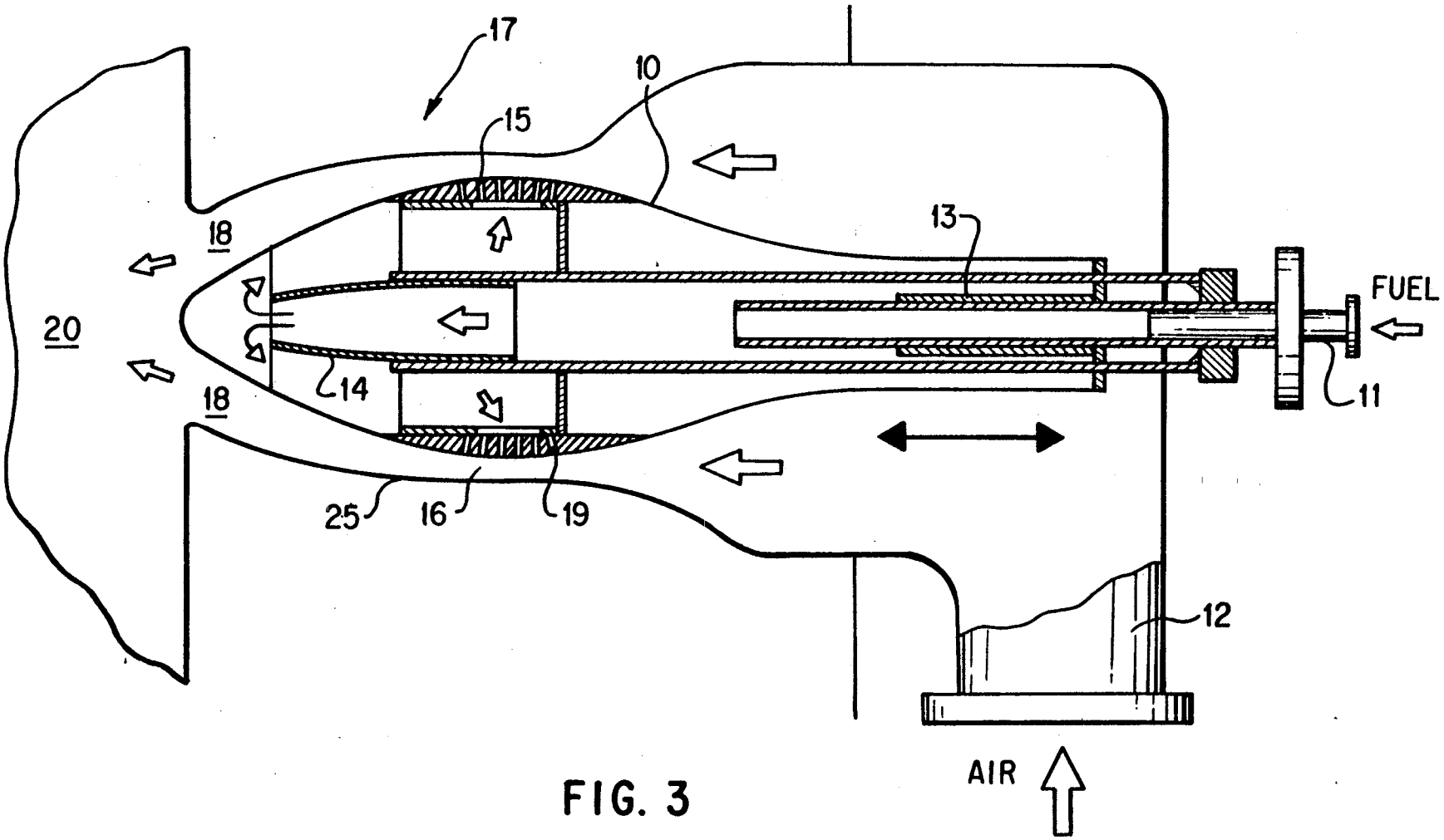
FIG. 3 is a cross-sectional side view of a variable velocity premixing axial nozzle with fuel/air ratio control in accordance with yet another embodiment of this invention.

FIG. 3 shows a premix fuel/air burner in accordance with yet another embodiment of this invention having a variable velocity axial premixing nozzle with fuel/air ratio control. In accordance with this embodiment, the resulting fuel/air mixture is introduced axially through nozzle exit 18 into combustion chamber 20.

While in the foregoing specification this invention has been described in relation to certain preferred embodiments thereof, and many details have been set forth for the purpose of illustration, it will be apparent to those skilled in the art that the invention is susceptible to additional embodiments and that certain other details described herein can be varied considerably without departing from the basic principles of the invention.

I claim:

1. A premix fuel/oxidant burner with velocity and fuel/air ratio control comprising:

a nozzle having a nozzle wall forming a Venturi mixer and a nozzle exit;

means for separately introducing fuel and oxidant into said nozzle;

a hollow body disposed inside said nozzle, said hollow body moveable in a longitudinal direction toward said nozzle exit;

said hollow body having at least one orifice through a wall of said hollow body at an angle with respect to a longitudinal axis of said nozzle; and flow control means for controlling a flow of said fuel through said orifice disposed at an inlet side of said orifice, said flow control means comprising a fixed orifice baffle secured to said means for moving said hollow body.

2. A premix fuel/oxidant burner in accordance with claim 1, wherein said hollow body has a shape whereby the cross-sectional area of said Venturi mixer and said nozzle exit is reduced as said hollow body is moved toward said nozzle exit.

3. A premix fuel/oxidant burner in accordance with claim 1, wherein said hollow body is in communication with said means for introducing fuel, said fuel being directed inside said hollow body.

4. A premix fuel/oxidant burner in accordance with claim 1, wherein said means for introducing said fuel into said nozzle comprises means for cooling an end of said hollow body facing said nozzle exit.

5. A premix fuel/oxidant burner in accordance with claim 4, wherein said means for cooling said end of said hollow body facing said nozzle exit comprises a flow baffle disposed at an outlet of said means for introducing said fuel, said flow baffle directing a stream of said fuel to contact said end of said hollow body.

6. A premix fuel/oxidant burner in accordance with claim 1, wherein said means for moving said hollow body comprises a slide means connected to said means for introducing said fuel, said means for introducing said fuel comprising a tubular member extending into said hollow body.

7. A premix fuel/oxidant burner in accordance with claim 1, further comprising a combustion chamber wall forming a combustion chamber downstream of said nozzle exit, said nozzle exit in communication with said combustion chamber.

8. A premix fuel/oxidant air burner in accordance with claim 7, wherein a refractory sleeve is disposed inside said combustion chamber forming an annular space between said refractory sleeve and said combustion chamber wall whereby flue gases resulting from the combustion of said premixed fuel and oxidant are recirculated from a downstream end of said combustion chamber through said annular space toward said nozzle exit.

* * * * *